US008460768B2

(12) United States Patent
Yener

(10) Patent No.: US 8,460,768 B2
(45) Date of Patent: Jun. 11, 2013

(54) APPLICATIONS OF SHAPED NANO ALUMINA HYDRATE IN INKJET PAPER

(75) Inventor: Doruk O. Yener, Wilmington, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 410 days.

(21) Appl. No.: 12/636,022

(22) Filed: Dec. 11, 2009

(65) Prior Publication Data

US 2010/0151160 A1 Jun. 17, 2010

Related U.S. Application Data

(60) Provisional application No. 61/138,475, filed on Dec. 17, 2008.

(51) Int. Cl.
*B41M 5/40* (2006.01)

(52) U.S. Cl.
USPC ..... 428/32.21; 428/32.24; 428/32.25; 428/32.34; 428/32.35; 428/32.37

(58) Field of Classification Search
CPC ..... B41M 5/5218; B41M 5/506; B41M 5/52
USPC ..... 428/32.21, 32.24, 32.25, 32.34, 32.35, 428/32.37
See application file for complete search history.

(56) References Cited

U.S. PATENT DOCUMENTS

| | | | |
|---|---|---|---|
| 2,763,620 | A | 9/1956 | Bugosh |
| 2,915,475 | A | 12/1959 | Bugosh |
| 3,056,747 | A | 10/1962 | Arthur, Jr. |
| 3,108,888 | A | 10/1963 | Bugosh |
| 3,117,944 | A | 1/1964 | Harrell |
| 3,136,644 | A | 6/1964 | Pangonis |
| 3,202,626 | A | 8/1965 | FitzSimmons |
| 3,321,272 | A | 5/1967 | Kerr |
| 3,357,791 | A | 12/1967 | Napier |
| 3,385,663 | A | 5/1968 | Hughes |
| 3,387,447 | A | 6/1968 | Trammell et al. |
| 3,790,495 | A | 2/1974 | Podschus |
| 3,814,782 | A | 6/1974 | Hayes et al. |
| 3,842,111 | A | 10/1974 | Meyer-Simon et al. |
| 3,853,688 | A | 12/1974 | D'Ambrosio |

(Continued)

FOREIGN PATENT DOCUMENTS

| | | | |
|---|---|---|---|
| CN | 1237146 | A | 12/1999 |
| CN | 1266020 | A | 9/2000 |

(Continued)

OTHER PUBLICATIONS

L.A. Blank et al., "Modification of fillers for Ftorlon-4 with microfibrous boehmite", Sov. Plast., 1972, 2, 66-67.

(Continued)

*Primary Examiner* — Betelhem Shewareged
(74) *Attorney, Agent, or Firm* — Mike W. Crosby; Abel Law Group, LLP

(57) ABSTRACT

A paper includes a substrate and a polymer layer disposed over at least one side of the substrate. The paper further includes an aluminous material at least partially dispersed within the polymer layer. The aluminous material has a primary aspect ratio of at least about 1.5, a secondary aspect ratio of not greater than about 3.0, and a primary particle size between about 50 nm and about 1000 nm.

12 Claims, 3 Drawing Sheets

U.S. PATENT DOCUMENTS 3,865,599 A 2/1975 Mansmann et al.
3,865,917 A 2/1975 Galasso et al.
3,873,489 A 3/1975 Thurn et al.
3,950,180 A 4/1976 Kato
3,978,103 A 8/1976 Meyer-Simon et al.
3,997,581 A 12/1976 Pletka et al.
4,002,594 A 1/1977 Fetterman
4,105,465 A 8/1978 Berger
4,117,105 A 9/1978 Hertzenberg et al.
4,120,943 A 10/1978 Iwaisako et al.
4,344,928 A 8/1982 Dupin et al.
4,377,418 A 3/1983 Birchall et al.
4,386,185 A 5/1983 Macdonell et al.
4,492,682 A 1/1985 Trebillion
4,507,426 A 3/1985 Blake, Jr.
4,525,494 A 6/1985 Andy
4,539,365 A 9/1985 Rhee
4,558,102 A 12/1985 Miyata
4,623,738 A 11/1986 Sugerman et al.
4,632,364 A 12/1986 Smith
4,716,029 A 12/1987 Oguri et al.
4,769,179 A 9/1988 Kato et al.
4,797,139 A 1/1989 Bauer
4,835,124 A 5/1989 Pearson
4,891,127 A 1/1990 Dispenziere, Jr.
4,946,666 A 8/1990 Brown
4,992,199 A 2/1991 Meyer et al.
5,155,085 A 10/1992 Hamano et al.
5,194,243 A 3/1993 Pearson et al.
5,246,491 A 9/1993 Takahashi et al.
5,286,290 A 2/1994 Risley
5,302,368 A 4/1994 Harato et al.
5,306,680 A 4/1994 Fukuda
5,318,628 A 6/1994 Matijevic et al.
5,321,055 A 6/1994 Slocum
5,332,777 A 7/1994 Goetz et al.
5,344,489 A 9/1994 Matijevic et al.
5,352,835 A 10/1994 Dai et al.
5,401,703 A 3/1995 Fukuda
5,413,985 A 5/1995 Thome et al.
5,445,807 A 8/1995 Pearson
5,508,016 A 4/1996 Yamanishi et al.
5,550,180 A 8/1996 Elsik et al.
5,580,914 A 12/1996 Falla et al.
5,580,919 A 12/1996 Agostini et al.
5,583,245 A 12/1996 Parker et al.
5,605,750 A 2/1997 Romano et al.
5,656,566 A 8/1997 Ward
5,663,396 A 9/1997 Musleve et al.
5,684,171 A 11/1997 Wideman et al.
5,684,172 A 11/1997 Wideman et al.
5,696,197 A 12/1997 Smith et al.
5,707,716 A 1/1998 Yoshino et al.
5,723,529 A 3/1998 Bernard et al.
5,785,722 A 7/1998 Garg et al.
5,849,827 A 12/1998 Boediger et al.
5,900,449 A 5/1999 Custodero et al.
5,925,592 A 7/1999 Katoh
5,955,142 A 9/1999 Yoshino et al.
5,962,124 A 10/1999 Yoshino et al.
5,989,515 A 11/1999 Watanabe et al.
6,017,632 A 1/2000 Pinnavaia et al.
6,143,816 A 11/2000 Prescher et al.
6,146,770 A * 11/2000 Sargeant et al. ..... 428/32.38
6,156,835 A 12/2000 Anderson et al.
6,203,695 B1 3/2001 Harle et al.
6,261,674 B1 7/2001 Branham et al.
6,280,839 B1 8/2001 Brown et al.
6,338,891 B1 1/2002 Kawasaki et al.
6,403,007 B1 6/2002 Kido et al.
6,413,308 B1 7/2002 Xu et al.
6,417,286 B1 7/2002 Agostini et al.
6,420,305 B1 7/2002 Matsuzawa et al.
6,440,187 B1 8/2002 Kasai et al.
6,440,552 B1 8/2002 Kajihara et al.
6,485,656 B1 11/2002 Meyer et al.
6,486,254 B1 11/2002 Barbee et al.
6,506,358 B1 1/2003 Stamires et al.
6,534,584 B2 3/2003 Wideman et al.
6,576,324 B2 6/2003 Yoshino et al.
6,610,261 B1 8/2003 Custodero et al.
6,635,700 B2 10/2003 Cruse et al.
6,646,026 B2 11/2003 Fan et al.
6,648,959 B1 11/2003 Fischer et al.
6,653,387 B2 11/2003 Causa et al.
6,685,999 B2 2/2004 Ichinose et al.
6,689,432 B2 2/2004 Kitamura et al.
6,706,660 B2 3/2004 Park
6,747,087 B2 6/2004 Custodero et al.
6,841,207 B2 1/2005 Burch et al.
6,858,665 B2 2/2005 Larson
6,872,444 B2 3/2005 McDonald et al.
6,899,930 B2 5/2005 Kiyama et al.
6,924,011 B2 8/2005 Van Aert et al.
6,926,875 B2 8/2005 Hatanaka et al.
6,939,825 B1 9/2005 Ohno et al.
6,953,554 B2 10/2005 Wallin et al.
7,056,585 B2 6/2006 Mishima et al.
7,189,775 B2 3/2007 Tang et al.
7,211,612 B2 5/2007 Kikuchi et al.
7,226,647 B2 6/2007 Kasperchik et al.
7,479,324 B2 1/2009 Bianchi et al.
7,531,161 B2 5/2009 Tang et al.
2002/0004549 A1 1/2002 Custodero et al.
2002/0106523 A1 8/2002 Urabe et al.
2002/0127385 A1 9/2002 Topolkaraev et al.
2002/0132960 A1 9/2002 Haile et al.
2002/0169243 A1 11/2002 Nippa
2003/0031851 A1 2/2003 Bourdelais et al.
2003/0078333 A1 4/2003 Kawaguchi et al.
2003/0095905 A1 5/2003 Scharfe et al.
2003/0185736 A1 10/2003 Hatanaka et al.
2003/0185739 A1 10/2003 Mangold et al.
2003/0197300 A1 10/2003 Tang et al.
2003/0202923 A1 10/2003 Custodero et al.
2004/0030017 A1 2/2004 Simonot et al.
2004/0096598 A1 5/2004 Kasamatsu et al.
2004/0120904 A1 6/2004 Lye et al.
2004/0166324 A1 8/2004 Mishima et al.
2004/0265219 A1 12/2004 Bauer et al.
2005/0028806 A1 2/2005 Kumamoto et al.
2005/0124745 A1 6/2005 Bauer et al.
2005/0146589 A1 7/2005 Gibbison et al.
2005/0227000 A1 10/2005 Bauer et al.
2005/0228073 A1 10/2005 Nishio et al.
2005/0237372 A1 10/2005 Kondo et al.
2005/0245394 A1 11/2005 Dahar et al.
2005/0267238 A1 12/2005 Mutin
2006/0096891 A1 5/2006 Stamires et al.
2006/0104895 A1 5/2006 Bauer et al.
2006/0106129 A1 5/2006 Gernon et al.
2006/0115634 A1 6/2006 Park et al.
2006/0148955 A1 7/2006 Guiselin et al.
2006/0182903 A1 8/2006 Sakaguchi et al.
2006/0223930 A1 10/2006 Matsumoto et al.
2007/0026170 A1 2/2007 Kawano et al.
2007/0104952 A1 5/2007 Bianchi et al.
2007/0116641 A1 5/2007 Takemura
2007/0129698 A1 6/2007 Vukos et al.
2007/0148083 A1 6/2007 Bauer et al.
2007/0190279 A1 8/2007 Mussig et al.
2007/0194289 A1 8/2007 Anglin et al.
2008/0003131 A1 1/2008 Bauer et al.
2008/0031808 A1 2/2008 Bauer et al.
2008/0138622 A1 * 6/2008 Guiselin et al. ..... 428/405

FOREIGN PATENT DOCUMENTS

CS 195426 5/1982
DE 956535 1/1957
DE 2163678 7/1973
DE 2408122 8/1974
DE 2952666 7/1980
DE 19931204 1/2001
EP 0038620 A2 10/1981
EP 0015196 4/1982
EP 0108968 A1 5/1984
EP 0304721 A1 3/1989

| | | | |
|---|---|---|---|
| EP | 0563653 | A1 | 10/1993 |
| EP | 0667405 | A1 | 8/1995 |
| EP | 0501227 | B1 | 12/1995 |
| EP | 0735001 | A2 | 10/1996 |
| EP | 0736392 | A1 | 10/1996 |
| EP | 0885844 | A1 | 12/1998 |
| EP | 0896021 | A1 | 2/1999 |
| EP | 1225200 | A2 | 7/2002 |
| EP | 1256599 | A1 | 11/2002 |
| EP | 1323775 | A1 | 7/2003 |
| EP | 0697432 | B1 | 10/2003 |
| EP | 1000965 | B1 | 10/2003 |
| EP | 0807603 | B1 | 12/2003 |
| EP | 1112961 | B1 | 9/2004 |
| EP | 1580223 | A | 9/2005 |
| FR | 2927267 | A1 | 8/2009 |
| GB | 1022944 | | 3/1966 |
| GB | 1189304 | | 4/1970 |
| GB | 2248841 | A | 4/1992 |
| JP | 55116622 | A | 9/1980 |
| JP | 56009427 | A | 1/1981 |
| JP | 58026029 | A2 | 2/1983 |
| JP | 58185434 | A | 10/1983 |
| JP | 59193949 | | 11/1984 |
| JP | 60-046923 | | 3/1985 |
| JP | 61-179264 | A | 8/1986 |
| JP | H4-78586 | A | 9/1986 |
| JP | 62-030133 | A | 2/1987 |
| JP | 63147820 | A2 | 6/1988 |
| JP | 63147821 | A2 | 6/1988 |
| JP | S63-131321 | A | 6/1988 |
| JP | 05279019 | | 10/1993 |
| JP | 6322243 | | 11/1994 |
| JP | 07018174 | | 1/1995 |
| JP | 9-99627 | | 4/1997 |
| JP | 09208809 | | 8/1997 |
| JP | 09511258 | | 11/1997 |
| JP | H9-511258 | | 11/1997 |
| JP | 2686833 | B2 | 12/1997 |
| JP | 2000-86235 | A | 3/2000 |
| JP | 2000239014 | | 9/2000 |
| JP | 2001058818 | A | 3/2001 |
| JP | 2001-139326 | A | 5/2001 |
| JP | 2001180930 | | 7/2001 |
| JP | 20010207077 | | 7/2001 |
| JP | 2001-240633 | A | 9/2001 |
| JP | 2001261976 | | 9/2001 |
| JP | 2001-303458 | A | 10/2001 |
| JP | 2001-323188 | A | 11/2001 |
| JP | 2003002642 | | 1/2003 |
| JP | 2003054941 | | 2/2003 |
| JP | 2003107206 | | 4/2003 |
| JP | 2003238150 | | 8/2003 |
| JP | 2003238826 | A | 8/2003 |
| JP | 2003-313027 | A | 11/2003 |
| JP | 2004-001463 | A | 1/2004 |
| JP | 200459643 | A | 2/2004 |
| JP | 2004051390 | A2 | 2/2004 |
| JP | 2004-122784 | | 4/2004 |
| KR | 10-1999-0051408 | | 1/2002 |
| RU | 2148567 | C1 | 5/2000 |
| SU | 267064 | A | 7/1970 |
| SU | 1444080 | A1 | 12/1988 |
| WO | 9511270 | | 4/1995 |
| WO | 9723566 | | 7/1997 |
| WO | 9814426 | | 4/1998 |
| WO | 9935089 | A1 | 7/1999 |
| WO | 0188265 | A2 | 11/2001 |
| WO | 03/011941 | A2 | 2/2003 |
| WO | 03/011941 | A3 | 2/2003 |
| WO | 03089508 | A1 | 10/2003 |
| WO | 2004016630 | A1 | 2/2004 |
| WO | 2004056915 | A1 | 7/2004 |
| WO | 2004090023 | A1 | 10/2004 |
| WO | 2005100244 | A2 | 10/2005 |
| WO | 2005100491 | A2 | 10/2005 |
| WO | 2006002993 | A1 | 1/2006 |
| WO | 2006049863 | A1 | 5/2006 |
| WO | 2006060206 | A1 | 6/2006 |
| WO | 2006060468 | A3 | 6/2006 |
| WO | 2007056404 | A1 | 5/2007 |
| WO | 2008070515 | A | 6/2008 |
| WO | 2008070520 | A | 6/2008 |
| WO | 2008079710 | A | 7/2008 |
| WO | 2009109722 | A1 | 9/2009 |

OTHER PUBLICATIONS

Paul A. Buining et al., "Preparation on (non-)aqueous dispersions of colloidal boehmite needles", Chemical Engineering Science, 48(2), 411-417, 1993.

Johann Buitenhuis et al., "Phase separation of mixtures of colloidal boehmite rods and flexible polymer," Journal of Colloid and Interface Science, 1995, 175, 46-56.

V.G. Fitzsimmons, W.A. Zisman, "Microfiber reinforcement of polytetrafluoroethylene", Modern Plastics, 1963, 40(5), 151-154, 158, 160-162, 238-241.

John Bugosh et al., "A Novel fine alumina powder, fibrillar boehmite", I&EC Product Research and Development, vol. 1, No. 3, Sep. 1962.

P.A. Buining et al., "Preparation and properties of dispersions of colloidal boehmite rods", Progr Colloid Polym Sci 93:10-11 (1993).

Sridhar Komarneni, "Nanocomposites", J. Mater. Chem., 1992, 2(12), 1219-1230.

S. Furuta et al., "Preparation and properties of fibrous boehmite sol and its application for thin porous membrane", Journal of Materials Science Letters 13 (1994) 1077-1080.

B.S. Gevert and Zhong-Shu Ying, "Formation of fibrillar boehmite", Journal of Porous Materials, 6, 63-67 (1999).

M.P.B. Van Bruggen, "Preparation and properties of colloidal core-shell rods with adjustable aspect ratios", Langmuir 1998, 14, 2245-2255.

John Bugosh, "Colloidal alumina—the chemistry and morphology of colloidal boehmite", J. Phys. Chem., 1961, 65(10), pp. 1789-1793.

Paul A. Buining et al., "Effect of hydrothermal conditions on the morphology of colloidal boehmite particles: Implications for fibril formation and monodispersity", J. Am. Ceram. Soc., 1990, 73[8] 2385-90.

Thomas J. Martin, Sasol Presentation given on—Functionalized Aluminas, NABELTECH, web page: http://www.nabaltec.de/seiten_d/boehmit_d/anwendungen/news_05_08_98.htm.

Fisch, H., et al., "Hybrid Materials Based on Polymer Matrices & Organic Components", NTIS, Germany 1994.

Buining et al., J. Am. Ceram. Soc. vol. 74 [6], pp. 1303-1307.

Anonymous: "High Purity Dispersible Aluminas"; URL:http://www.sasol.com/sasol_internet/downloads/DISPERAL-DISPAL_1055338543391. pdf>abstract; tables 1,2.

Boccaccini A. R. et al; "Alumina Ceramics Based on Seeded Boehmite and Electrophoretic Deposition"; Ceramics International; Elsevier; Amsterdam, NL; vol. 28, No. 8; 2002; pp. 893-897.

Grant et al., "Grant and Hackh's Chemical Dictionary", 5th Ed., (1987), McGraw-Hill Book. Co. USA, ISBN 0-07-024067-1, p. 160.

Zhang, L. et al., "Preparation and Characterization of Nano-fibrous g-Al2O3," Shiyou Huagong, vol. 33, No. 3, pp. 240-243, 2004. Abstract Only.

Zhu H., et al., "Growth of Boehmite Nanoribers by Assembling Nanoparticles with Surfactant Micelles," Journal of Physical Chemistry, vol. 108, No. 14, pp. 4245-4247, 2006. Abstract Only.

"Halogenated Polyolefin," Thermoplastc Elastomers Properties and Applications, Rapra Review Reports, vol. 7, pp. 17-18, 1995.

Cuneyt Tas, A., "Chemical Preparation of the Binary Compounds in the Calcia-Alumina Systems by Self-Propagating Combustion Synthesis," J. Am. Ceram. Soc., vol. 81, No. 11, pp. 2853-2863, 1998.

Tsai, D., et al., "Controlled Gelation and Sintering of Monolithic Gels Prepared from gamma-Alumina Fume Powder," J. Am. Ceram. Soc., vol. 74, No. 4, pp. 830-836, 1991.

Alexander, K. et al., "Grain Growth Kinetics in Alumina-Zirconia (CeZTA) Composites," J. Am. Ceram. Soc., vol. 77, No. 4, pp. 939-946, 1994.

Okada, K. et al., "Effect of Divalent Cation Additives on the gamma-Al2O3-to-Al2O3 Phase Transition," J. Am. Ceram. Soc., vol. 83, No. 4, pp. 928-932, 2000.

Brusasco, Raymond, M. "Preparation and Characterization of Acicular Particles and Thin Films of Aluminum Oxide," Thesis Brown University, May 1987, 107 pgs.
Etchells, David, "A "Universal" Inkjet Paper," http://www.imaging-resource.com/ARTS/IJPAPER/IJPAPER1.HTM, Nov. 20, 2007, posted Apr. 24, 2000, 6 pgs.
N. G. Papayannakos et al., "Effect of seeding during precursor preparation on the pore structure of alumina catalyst supports," Microporous Materials, Oct. 19, 1993, vol. 1, No. 6, pp. 413-422.
C. Skoufadis et al., "Kinetics of boehmite precipitation from supersturated sodium aluminate solutions," Hydrometallurgy, Feb. 2003, vol. 68, No. 1-3, pp. 57-68.
D. Panias, "Role of boehmite/solution interface in boehmite precipitation from supersaturated sodium aluminate solutions," Hydrometallurgy, Oct. 2004, vol. 74, No. 3-4, pp. 203-212.
U.S. Appl. No. 10/414,590, filed Apr. 16, 2003, Inventors: Ralph Bauer et al.
U.S. Appl. No. 11/685,000, filed Mar. 12, 2007, Inventors: Ralph Bauer et al.
U.S. Appl. No. 10/823,400, filed Apr. 13, 2004, Inventors: Ralph Bauer et al.
U.S. Appl. No. 10/978,286, filed Oct. 29, 2004, Inventors: Ralph Bauer et al.
U.S. Appl. No. 12/399,751, filed Mar. 6, 2009, Inventors: Ralph Bauer et al.
U.S. Appl. No. 10/845,764, filed May 14, 2004, Inventors: Ralph Bauer et al.
U.S. Appl. No. 11/834,527, filed Aug. 6, 2007, Inventors: Ralph Bauer et al.
U.S. Appl. No. 10/992,477, filed Nov. 18, 2004, Inventors: Ralph Bauer et al.
U.S. Appl. No. 11/754,889, filed May 29, 2007, Inventors: Ralph Bauer et al.
U.S. Appl. No. 11/269,508, filed Nov. 8, 2005, Inventors: Catherine Bianchi et al.
U.S. Appl. No. 12/336,398, filed Dec. 16, 2008, Inventors: Catherine Bianchi et al.
U.S. Appl. No. 11/288,945, filed Nov. 29, 2005, Inventors: Olivier Guiselin et al.
U.S. Appl. No. 12/337,539, filed Dec. 17, 2008, Inventors: Doruk Yener.
Technical Search Results, pp. 1-25.
Brunauer, Stephen et al.; "Adsorption of Gases in Multimolecular Layers," J. Am. Chem. Soc.; 1938; 60 (2), pp. 309.

* cited by examiner

APPLICATIONS OF SHAPED NANO ALUMINA HYDRATE IN INKJET PAPER

CROSS-REFERENCE TO RELATED APPLICATION(S)

The present application claims priority from U.S. Provisional Patent Application No. 61/138,475, filed Dec. 17, 2008, entitled "APPLICATIONS OF SHAPED NANO ALUMINA HYDRATE IN INKJET PAPER," naming inventor Doruk Omer Yener, which application is incorporated by reference herein in its entirety.

FIELD OF THE DISCLOSURE

This disclosure, in general, relates to applications of shaped alumina hydrate in inkjet papers.

BACKGROUND

Digital cameras and video recorders have been incorporated into a variety of devices, including cell phones, allowing consumers to take pictures in almost any setting. The resulting increase in use of digital photography has increased demand for digital image and document printing.

In addition to the ability of printers, the resolution of a print on inkjet paper is related to the ink absorption ability of the paper and the ability of the paper to limit bleeding. Generally, inkjet papers are multi-layer structures having a paper substrate layer and one or more coatings. The coatings often serve to hold the ink in place and protect the resulting image. However, typical inkjet papers suffer from a sufficient amount of bleeding, ink running, fading, and slow dry times to limit the resolution of print and images that can be printed on such typical inkjet papers.

As printers become available with increasing accuracy and resolution, demand for quality paper increases. Previous papers and coatings place limits on resolution and clarity of the printed image and text. As such, improved papers and coatings are desired.

SUMMARY

In a particular embodiment, an inkjet paper includes a substrate and a polymer layer disposed on at least one side of the substrate. The inkjet paper further includes an aluminous material dispersed within the polymer layer. The aluminous material has a primary aspect ratio of at least about 1.5, a secondary aspect ratio of not greater than about 3.0, and a primary particle size of between about 50 nm and about 1000 nm.

In an exemplary embodiment, a method of making an inkjet paper includes treating a paper substrate with a sizing material. The sizing material includes an aluminous material having a primary aspect ratio of at least about 1.5, a secondary aspect ratio of not greater than about 3.0, and a primary particle size of between about 50 nm and about 1000 nm.

In another exemplary embodiment, a method of making an inkjet paper includes coating a paper substrate with a polymer mixture. The polymer mixture includes an aluminous material having a primary aspect ratio of at least about 1.5, a secondary aspect ratio of not greater than about 3.0, and a primary particle size of between about 50 nm and about 1000 nm.

In yet another exemplary embodiment, a paper includes a first layer, a second layer overlying the first layer, and a third layer overlying the second layer. At least one of the first layer, the second layer or the third layer includes an aluminous material. The aluminous material has a primary aspect ratio of at least about 1.5, a secondary aspect ratio of not greater than about 3.0, and a primary particle size of between about 50 nm and about 1000 nm.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

In a particular embodiment, a paper such as an inkjet paper, includes a substrate and a coating disposed on at least one side of the substrate. The paper further includes an aluminous material dispersed within the coating. In an example, the aluminous material has a primary aspect ratio of at least about 1.5, a secondary aspect ratio of not greater than about 3.0, and a primary particle size of between about 50 nm and about 1000 nm. The coating can further include a polymer. In another example, the aluminous material consists essentially of alumina hydrate.

In an exemplary embodiment, a method of making a paper product includes treating a paper substrate with a sizing material. The sizing material includes an aluminous material having a primary aspect ratio of at least about 1.5, a secondary aspect ratio of not greater than about 3.0, and a primary particle size of between about 50 nm and about 1000 nm.

Figure 5:
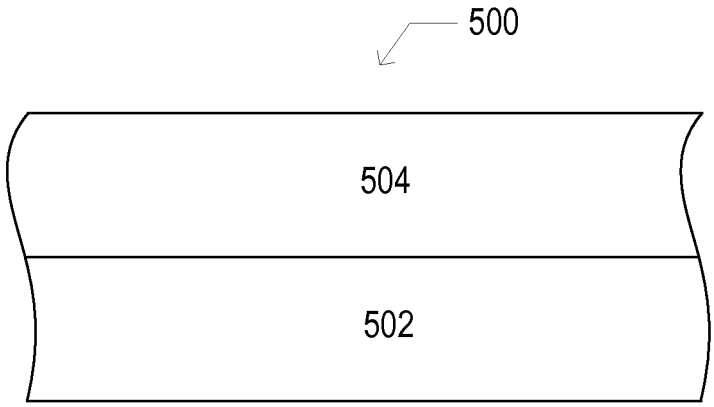
FIG. 5 and FIG. 6 are diagrams illustrating layered paper products.

FIG. 5 illustrates an exemplary paper 500 including a substrate 502 and image-recording layer 504. Optionally, the paper 500 can include a second image-recording layer on the reverse of the substrate 502.

In an example, the substrate 502 provides mechanical properties of the paper 500. The substrate 502 can be formed from fibrous material, including, for example, virgin hardwood, virgin softwood, recycled hardwood, recycled softwood fibers, or any combination thereof. Further, substrate 502 can be formed from polymer fibers or a film or sheet of polymer. In an example, the polymer can include polyester resin, diacetate resin, triacetate resin, acrylic resin, polycarbonate resin, polyvinyl chloride resin, polyamide resin, or any combination thereof.

In addition, the substrate 502 can include a filler. In an exemplary embodiment, the filler is an aluminous material. In particular, the filler can include anisotropic alumina particles, such as needle and platelet shaped particles. Specifically, the filler can include anisotropic alumina particles having a primary aspect ratio of at least about 1.5, a secondary aspect ratio of not greater than about 3.0 and a primary particle size of between about 50 nm and about 1000 nm. In an exemplary embodiment, the filler can increase the mechanical properties, such as the flexural modulus, of the substrate 502 and thus, the paper 500. The aluminous material can be used alone, or in combination with other fillers, such as clay, kaolin, calcium carbonate, gypsum, titanium oxide, talc, and magnesium oxide.

The image-recording layer 504 may be capable of absorbing the ink and retaining pigments. The ink used in inkjet printers generally includes a pigment dispersed in a solution. Often, the solution is a polar solution, including a polar solvent, such as an alcohol, water, or any combination thereof.

In an example, the image-recording layer 504 can include a binder and an aluminous material. The binder can include gelatin, a polymer, or any combination thereof. The polymer can include polyvinyl alcohol, polyurethane, butadiene-styrene copolymer, cellulose acetate proprionate, or any combination thereof. The aluminous particulate can be anisotropic alumina particles, such as particles having a primary aspect ratio of at least about 1.5, a secondary aspect ratio of not greater than about 3.0, and a primary particle size between about 50 nm and about 1000 nm. For example, the alumina particles can form open structures with loose packing, increasing the porosity of the absorbent layer 504.

In either the substrate 502 or the image recording layer 504, the aluminous material can have a desirable property, including aspect ratio, average particle size or surface area, as described below. Further, the aluminous material can be provided in agglomerates forms having the properties described below.

Figure 6:
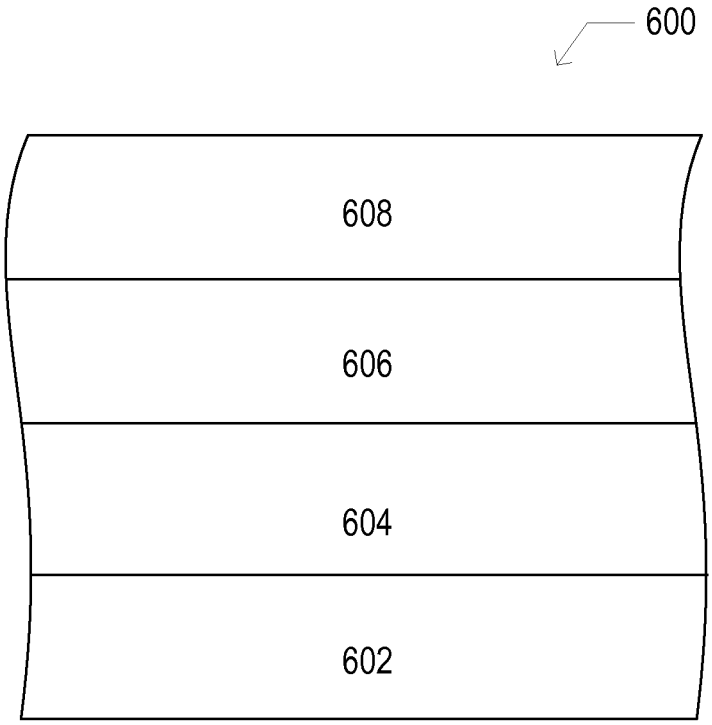

In a further embodiment, FIG. 6 illustrates an exemplary paper 600. The paper includes a substrate 602 and an image-recording layer 604, as previously described. Optionally, the paper 600 can include additional layers, such as a humidity barrier layer 606 or an absorbent layer 608.

In an example, the humidity barrier layer 606 can reduce the sensitivity of the paper to humidity, such as by reducing the amount of water vapor that contacts the image recording layer. When an ink is contacted with the paper 600, the ink substantially permeates through the humidity barrier layer 606 and is absorbed by the image-recording layer 604.

The humidity barrier layer 606 can include a polymer, such as polyethylene oxide, and an aluminous material. Specifically, the aluminous material can include particles having a primary aspect ratio of at least about 1.5, a secondary aspect ratio of not greater than about 3.0, and a primary particle size between about 50 nm and about 1000 nm.

The absorbent layer 608, for example, can absorb the solvent carrier in the ink, reducing lateral migration of the pigments in the ink. The absorbent layer can include a water-insoluble polymer and an aluminous material. In general, any substantially water-insoluble thermoplastic polymer can be used. The polymer can be a single polymer or it can be a mixture of polymers. An example of a substantially water-insoluble thermoplastic polymer includes a thermoplastic polyolefin, poly(halo-substituted olefin), polyester, polyamide, polyurethane, polyurea, poly(vinyl halide), poly(vinylidene halide), polystyrene, poly(vinyl ester), polycarbonate, polyether, polysulfide, polyimide, polysilane, polysiloxane, polycaprolactone, polyacrylate, polyethylene, polymethacrylate, or any combination thereof. The aluminous material can include anisotropic alumina particles, such as alumina particles having a primary aspect ratio of at least about 1.5, a secondary aspect ratio of not greater than about 3.0, and a primary particle size between about 50 nm and about 1000 nm.

To form a paper, a paper substrate can be provided. For example, the substrate can be formed to include alumina particles, such as the alumina particles described below. Optionally, an absorbent layer can be applied to the substrate. For example, the absorbent layer can be laminated onto the substrate, or coated onto the substrate, such as by spray coating, dip coating, cast coating, or any combination thereof. The absorbent layer can be applied to one or both sides of the substrate. In an embodiment, the absorbent layer can be formed from a solution including a solvent, a polymer, and an aluminous material. In particular, the solution can be a latex solution. Alternatively, a composite blend of polymer and aluminous material can be laminated or extruded over the paper substrate.

Further, an image-recording layer can be applied to one or both sides of the substrate. For example, the image-recording layer can be laminated onto the substrate, or coated onto the substrate. In an example, the image-recording layer can be formed from a solution including a solvent, a polymer, and an aluminous material. In particular, the solution can be a latex solution. Alternatively, a composite blend of polymer and aluminous material can be laminated or extruded over the paper substrate.

Also, an optional humidity barrier layer can be applied to one or both sides of the substrate, such as by laminating or coating. In an embodiment, the humidity barrier layer can be formed from a solution including a solvent, a polymer, and an aluminous material. In particular, the solution can be a latex solution. Alternatively, a composite blend of polymer and aluminous material can be laminated or extruded over the paper substrate.

In general, the aluminous material optionally is included in one or more of the layers of the paper anisotropic particles as described below. Further, particular layers can derive advantages from an agglomerated aluminous material. The agglomerated aluminous material may include at least about 5% aggregate material, particularly at least about 15% aggregate material, such as at least about 30% aggregate material. In a further example, the agglomerated aluminous material may include not more than about 70% dispersed particulate, particularly not more than about 85% dispersed particulate, such as not more than about 95% dispersed particulate.

In an exemplary embodiment, the aluminous material can include a seeded alumina hydrate particulate. In general, the alumina hydrate particulate material includes hydrated alumina conforming to the formula: $Al(OH)_aO_b$, where $0<a\leqq 3$, such as $1\leqq a\leqq 2$, and $b=(3-a)/2$. The alumina hydrate particulate material can have a positive surface charge. Further, the alumina hydrate particulate material can have a water content of about 1% to about 38% by weight, such as about 15% to about 38% water content by weight. In a particular embodiment, the alumina hydrate particulate material is free of non-alumina ceramic materials, and, in particular, is free of silica and aluminosilicate materials. By way of example, when a=0 the formula corresponds to alumina ($Al_2O_3$).

Alumina hydrate particulate materials can include aluminum hydroxides, such as ATH (aluminum tri-hydroxide), in mineral forms known commonly as gibbsite, bayerite, or bauxite, or can include alumina monohydrate, also referred to as boehmite. Such mineral form aluminum hydroxides can form alumina hydrate particulate material useful in forming the filler.

According to an embodiment, the alumina hydrate particles have a primary aspect ratio, defined as the ratio of the longest dimension to the next longest dimension perpendicular to the longest dimension. In an embodiment, the longest dimension and the second longest dimension can be substantially similar and the primary aspect ratio can be about 1:1. In an alternative embodiment, the longest dimension and the second longest dimension can be different and the primary aspect ratio can be generally at least about 1.5:1, such as at least about 2:1, and, in particular, at least about 3:1, such as at least about 4:1, or at least about 6:1. Particular embodiments have relatively elongated particles, having primary aspect ratios such as at least about 8:1, at least about 10:1, and, in particular examples, at least about 14:1.

With particular reference to the morphologies of the alumina hydrate particles, different morphologies are available, such as needle-shaped particles, platelet-shaped particles, and clusters of platelet-shaped particles. For example, particles having a needle-shaped morphology can be further characterized with reference to a secondary aspect ratio defined as the ratio of the second longest dimension to the third longest dimension perpendicular to the first and second longest dimensions. The secondary aspect ratio of a needle-shaped particle is generally not greater than about 3:1, typically not greater than about 2:1, or not greater than about 1.5:1, and oftentimes about 1:1. For a needle-shaped particle, the secondary aspect ratio generally describes the cross-sectional geometry of the particles in a plane perpendicular to the longest dimension. It is noted that since the term aspect ratio is used herein to denote the ratio of the longest dimension to the next longest dimension, it can be referred as the primary aspect ratio.

According to another embodiment, the alumina hydrate particle can be a platy or platelet-shaped particle generally of an elongated structure having a primary aspect ratio described above in connection with the needle-shaped particles. However, a platelet-shaped particle generally has opposite major surfaces, the opposite major surfaces being generally planar and generally parallel to each other. In addition, the platelet-shaped particle can be characterized as having a secondary aspect ratio greater than that of needle-shaped particles, generally at least about 3:1, such as at least about 6:1, or at least about 10:1. Typically, the shortest dimension or edge dimension, perpendicular to the opposite major surfaces or faces, is generally less than 50 nanometers, such as less than about 40 nanometers, or less than about 30 nanometers.

According to another embodiment, a cluster of platelet-shaped particles can generally form an elongated structure having a primary aspect ratio described above in connection with the needle-shaped particles. In addition, the ellipsoidal-shaped cluster can be characterized as having a secondary aspect ratio not greater than about 2:1, not greater than about 1.5:1, or about 1:1.

Individual alumina hydrate particles can have an average longest particle dimension of not greater than about 2000 nm. For example, the average largest particle dimension can be not greater than about 1000 nm, such as not greater than about 500 nm. Due to process constraints of certain embodiments, the smallest average particle size is generally at least about 50 nm, such as greater than 50 nm, particularly at least about 75 nm, such as at least about 100 nm, or at least about 135 nm. Additionally, individual alumina hydrate particles can have an average shortest particle dimension not greater than about 50 nm. In particular, the average largest particle dimension can be in a range between about 50 nm to about 1000 nm, such as about 50 nm to about 500 nm, about 50 nm to about 300 nm, or even about 100 nm to about 250 nm.

Due to the non-spherical morphology of the particles, conventional characterization technology is generally inadequate to measure average particle size, since characterization technology is generally based upon an assumption that the particles are spherical or near-spherical. Accordingly, average particle size was determined by taking multiple representative samples and physically measuring the particle sizes found in representative samples. Such samples can be taken by various characterization techniques, such as by scanning electron microscopy (SEM). The term average particle size also denotes primary particle size, related to the individually identifiable particles, whether in dispersed or agglomerated forms. Of course, agglomerates have a comparatively larger average particle size.

In addition to aspect ratio and average particle size of the alumina hydrate particulate material, morphology of the particulate material can be further characterized in terms of specific surface area. Herein, the $C_{BET}$ value and the specific surface area of the particulate material relate to specific surface area as measurable by the commonly available BET technique. In an exemplary embodiment, the $C_{BET}$ value of the unmodified alumina hydrate particulate material is at least about 120, such as at least about 150. According to embodiments herein, the alumina hydrate particulate material has a specific surface area, generally at least about 10 $m^2/g$, such as at least about 20 $m^2/g$, at least about 30 $m^2/g$, at least about 40 $m^2/g$, or at least about 70 $m^2/g$. Since specific surface area is a function of particle morphology as well as particle size, generally the specific surface area of embodiments is not greater than about 250 $m^2/g$, such as not greater than about 200 $m^2/g$ or not greater than about 90 $m^2/g$. In particular, the surface area can be about 50 $m^2/g$ to 250 $m^2/g$. In an exemplary embodiment, needle shaped alumina hydrate particulate has a specific surface area of at least about 40 $m^2/g$, generally at least about 100 $m^2/g$, such as at least about 200 $m^2/g$. In another exemplary embodiment, needle shaped alumina hydrate particulate has a specific surface area of not greater than about 250 $m^2/g$. The platelet shaped alumina hydrate particulate can have a specific surface area about 50 $m^2/g$ to about 98 $m^2/g$.

In the context of one aluminous seeded material example, processing begins with provision of a solid particulate boehmite precursor and boehmite seeds in a suspension, and heat treating (such as by hydrothermal treatment) the suspension (alternatively sol or slurry) to convert the boehmite precursor into boehmite particulate material formed of particles or crystallites. While certain embodiments make use of the as-formed hydrothermally-treated product for use as a filler, other embodiments utilize heat treatment to effect polymorphic transformation into alumina, particularly transitional alumina. According to one aspect, the particulate material (including boehmite and transitional alumina) has a relatively elongated morphology, as already described above. In addition, the morphological features associated with the boehmite are preserved in the transitional aluminous material.

The term "boehmite" is generally used herein to denote alumina hydrates including mineral boehmite, typically being $Al_2O_3.H_2O$ and having a water content on the order of 15%, as well as psuedoboehmite, having a water content higher than 15%, such as 20-38% by weight. It is noted that boehmite (including psuedoboehmite) has a particular and identifiable crystal structure, and accordingly unique X-ray diffraction pattern, and as such, is distinguished from other aluminous materials including other hydrated aluminas, such as ATH (aluminum trihydroxide), a common precursor material used herein for the fabrication of boehmite particulate materials.

Turning to the details of the processes by which the seeded aluminous particulate material can be manufactured, typically an aluminous material precursor including bauxitic minerals, such as gibbsite and bayerite, are subjected to hydrothermal treatment as generally described in the commonly owned, U.S. Pat. No. 4,797,139. More specifically, the particulate material can be formed by combining the precursor and seeds (having desired crystal phase and composition, such as boehmite seeds) in suspension, exposing the suspension (alternatively sol or slurry) to heat treatment to cause conversion of the raw material into the composition of the seeds (in this case boehmite). The seeds provide a template for crystal conversion and growth of the precursor. Heating is generally carried out in an autogenous environment, that is, in an autoclave, such that an elevated pressure is generated during processing. The pH of the suspension is generally selected from a value of less than 7 or greater than 8, and the boehmite seed material has a particle size finer than about 0.5 microns, preferably less than 100 nm, and even more preferably less than 10 nm. In the case the seeds are agglomerated, the seed particles size refers to seed primary particles size. Generally, the seed particles are present in an amount greater than about 1% by weight of the boehmite precursor, typically at least 2% by weight, such as 2 to 40% by weight, more typically 5 to 15% by weight (calculated as $Al_2O_3$). Precursor material is typically loaded at a percent solids content of 60% to 98%, preferably 85% to 95%. Heating is carried out at a temperature greater than about 120° C., such as greater than about 100° C., or even greater than about 120° C., such as greater than about 130° C. In one embodiment the processing temperature is greater than 150° C. Usually, the processing temperature is below about 300° C., such as less than about 250° C. Processing is generally carried out in the autoclave at an elevated pressure such as within a range of about $1\times10^5$ newtons/$m^2$ to about $8.5\times10^6$ newtons/$m^2$. In one example, the pressure is autogenously generated, typically around $2\times10^5$ newtons/$m^2$.

In the case of relatively impure precursor material, such as bauxite, generally the material is washed, such as rinsing with de-ionized water, to flush away impurities such as silicon and titanium hydroxides and other residual impurities remaining from the mining processes to source bauxite.

The particulate aluminous material can be fabricated with extended hydrothermal conditions combined with relatively low seeding levels and acidic pH, resulting in preferential growth of boehmite along one axis or two axes. Longer hydrothermal treatment can be used to produce even longer and higher aspect ratio of the boehmite particles or larger particles in general. Time periods typically range from about 1 to 24 hours, preferably 1 to 3 hours.

Several variables can be modified during the processing of the particulate material to effect the desired morphology. These variables notably include the weight ratio, that is, the ratio of precursor (i.e., feed stock material) to seed, the particular type or species of acid or base used during processing (as well as the relative pH level), and the temperature (which is directly proportional to pressure in an autogenous hydrothermal environment) of the system.

In particular, when the weight ratio is modified while holding the other variables constant, the shape and size of the particles forming the boehmite particulate material are modified. For example, when processing is carried at 180° C. for two hours in a 2 weight % nitric acid solution, a 90:10 ATH: boehmite ratio (precursor:seed ratio) forms needle-shaped particles (ATH being a species of boehmite precursor). In contrast, when the ATH:boehmite seed ratio is reduced to a value of 80:20, the particles become more elliptically shaped. Still further, when the ratio is further reduced to 60:40, the particles become near-spherical. Accordingly, most typically the ratio of boehmite precursor to boehmite seeds is not less than about 60:40, such as not less than about 70:30 or 80:20. However, to ensure adequate seeding levels to promote the fine particulate morphology that is desired, the weight ratio of boehmite precursor to boehmite seeds is generally not greater than about 98:2. Based on the foregoing, an increase in weight ratio generally increases aspect ratio, while a decrease in weight ratio generally decreases aspect ratio.

Further, when the type of acid or base is modified, holding the other variables constant, the shape (e.g., aspect ratio) and size of the particles are affected. For example, when processing is carried out at 180° C. for two hours with an ATH: boehmite seed ratio of 90:10 in a 2 weight % nitric acid solution, the synthesized particles are generally needle-shaped. In contrast, when the acid is substituted with HCl at a content of 1 weight % or less, the synthesized particles are generally near spherical. When 2 weight % or higher of HCl is utilized, the synthesized particles become generally needle-shaped. At 1 weight % formic acid, the synthesized particles are platelet-shaped. Further, with use of a basic solution, such as 1 weight % KOH, the synthesized particles are platelet-shaped. When a mixture of acids and bases is utilized, such as 1 weight % KOH and 0.7 weight % nitric acid, the morphology of the synthesized particles is platelet-shaped. Noteworthy, the above weight % values of the acids and bases are based on the solids content only of the respective solid suspensions or slurries, that is, are not based on the total weight % of the total weight of the slurries.

Suitable acids and bases include mineral acids such as nitric acid, organic acids such as formic acid, halogen acids such as hydrochloric acid, and acidic salts such as aluminum nitrate and magnesium sulfate. Effective bases include, for example, amines including ammonia, alkali hydroxides such as potassium hydroxide, alkaline hydroxides such as calcium hydroxide, and basic salts.

Still further, when temperature is modified while holding other variables constant, typically changes are manifested in particle size. For example, when processing is carried out at an ATH:boehmite seed ratio of 90:10 in a 2 weight % nitric acid solution at 150° C. for two hours, the crystalline size from XRD (x-ray diffraction characterization) was found to be 115 Angstroms. However, at 160° C. the average particle size was found to be 143 Angstroms. Accordingly, as temperature is increased, particle size is also increased, representing a directly proportional relationship between particle size and temperature.

Following heat treatment and crystalline conversion, the liquid content is generally removed, desirably through a process that limits agglomeration of the particles of boehmite upon elimination of water, such as freeze drying, spray drying, or other techniques to prevent excess agglomeration. In certain circumstances, ultrafiltration processing or heat treatment to remove the water might be used. Thereafter, the resulting mass can be crushed, such as to 100 mesh, if needed. It is noted that the particulate size described herein generally describes the single crystallites formed through processing, rather than any aggregates that can remain in certain embodiments.

In an exemplary embodiment, the alumina hydrate particulate has an average agglomerate size not greater than about 30 microns. Agglomerates are defined herein as an adhered set of alumina particles. For example, the alumina hydrate particulate can have an average agglomerate size not greater than about 25 microns, such as not greater than about 20 microns, or even not greater than about 15 microns. In a particular example, the average aggregate size is between 100 nm and 5 microns.

Alternatively, the alumina hydrate particulate can be aggregated either in solution or through a fast drying process, resulting in particle agglomerates of alumina hydrate. For example, the particle agglomerates can have a size of at least about 60 microns, such as at least about 100 microns, particularly at least about 150 microns. The particle agglomerates of alumina hydrate can be characterized by pore volume, pore size, and specific surface area (SSA). Pore volume, pore size, and specific surface area can be measure using Hg porosimetry or BET methods.

The Hg porosimetry is measured in accordance to DIN 66 133. Hg porosimetry results can be used to determine an Hg Pore Volume and an Hg Pore Size. The Hg Pore Volume (cc/g) is the total volume of the pores, as determined by Hg porosimetry, less than about 10 microns. The Hg Pore Size (nm) is the median pore size, as determined by Hg porosimetry, of pores less than about 10 microns. In an exemplary embodiment, the Hg Pore Volume of the particle agglomerates can be generally at least about 0.5 cc/g, preferably at least about 0.6 cc/g, such as at least about 0.7 cc/g. Additionally, the Hg Pore Size of the particle agglomerates is generally at least about 10.0 nm, and in particular, at least about 15.0 nm, such as at least about 20.0 nm.

BET pore volume can be determined according to ISO 5794. BET pore volume results can be used to determine a BET Pore Volume, BET Pore Size, and BET Specific Surface Area. The BET Pore Volume is the total volume of the pores less than about 1 microns. The BET Pore Size is the median pore size of pores less than about 1 microns. The BET Specific Surface Area ($m^2/g$) is the surface area, as determined by BET porosimetry. The BET Pore Volume of the particle agglomerate can be generally at least about 0.2 cc/g, such as at least about 0.3 cc/g, at least about 0.5 cc/g, and in particular, at least about 0.65 cc/g, such as at least about 0.7 cc/g. Additionally, the BET Pore Size of the particle agglomerates is generally at least about 10.0 nm, and in particular, at least about 15.0 nm, such as at least about 20.0 nm. Further, the BET Specific Surface Area of the particle agglomerates is generally at least about 100 $m^2/g$, and in particular, at least about 150 $m^2/g$, such as at least about 200 $m^2/g$.

As noted above, the as-formed hydrothermally processed particulate material can be used as the filler in certain embodiments, while in other embodiments, processing can continue to form a converted form of filler. In this case, the hydrothermally processed particulate material forms the feedstock material that can be further heat treated. In the case of boehmite particulate material from hydrothermal processing, further thermal treatment causes conversion to transitional alumina. Here, the boehmite feedstock material is heat treated by calcination at a temperature sufficient to cause transformation into a transitional phase alumina, or a combination of transitional phases. Typically, calcination or heat treatment is carried out at a temperature greater than about 250° C. At temperatures less than 250° C., transformation into the lowest temperature form of transitional alumina, gamma alumina, typically will not take place. At temperatures greater than 1100° C., typically the precursor will transform into the alpha phase. According to certain embodiments, calcination is carried out at a temperature greater than 500° C., such as not less than about 800° C.

Other embodiments are calcined at a temperature lower than 950° C., such as within a range of 750° C. to 950° C. to form a substantial content of delta alumina. According to particular embodiments, calcination is carried out at a temperature less than about 800° C., such as less than about 775° C. or 750° C. to effect transformation into a predominant gamma phase.

Calcination can be carried out in various environments including controlled gas and pressure environments. Because calcination is generally carried out to effect phase changes in the precursor material and not chemical reaction, and since the resulting material is predominantly an oxide, specialized gaseous and pressure environments need not be implemented except for most desired transitional alumina end products.

However, typically, calcination is carried out for a controlled time period to effect repeatable and reliable transformation from batch to batch. Here, most typically shock calcination is not carried out, as it is difficult to control temperature and hence control phase distribution. Accordingly, calcination times typically range from about 0.5 minutes to 60 minutes, typically, 1 minute to 15 minutes.

Generally, as a result of calcination, the particulate material is mainly (more than 50 wt %) transitional alumina. More typically, the transformed particulate material was found to contain at least 70 wt %, typically at least 80 wt %, such as at least 90 wt % transitional alumina. The exact makeup of transitional alumina phases may vary according to different embodiments, such as a blend of transitional phases, or essentially a single phase of a transitional alumina (e.g., at least 95 wt %, 98 wt %, or even up to 100 wt % of a single phase of a transitional alumina).

According to one particular feature, the morphology of the boehmite feedstock material is largely maintained in the final, as-formed transitional alumina. Accordingly, desirable morphological features can be engineered into the boehmite according to the foregoing teaching, and those features preserved. For example embodiments have been shown to retain at least the specific surface area of the feedstock material, and in some cases, increase surface area by amount of at least 8%, 10%, 12%, 14% or more.

In the context of seeded aluminous particulate material, particular significance is attributed to the seeded processing pathway, as not only does seeded processing to form seeded particulate material allow for tightly controlled morphology of the precursor (which is largely preserved in the final product), but also the seeded processing route is believed to manifest desirable physical properties in the final product, including compositional, morphological, and crystalline distinctions over particulate material formed by conventional, non-seeded processing pathways.

According to embodiments described herein, a relatively powerful and flexible process methodology can be employed to engineer desired morphologies into the final boehmite product. Of particular significance, embodiments utilize seeded processing resulting in a cost-effective processing route with a high degree of process control which can result in desired fine average particle sizes as well as controlled particle size distributions. The combination of (i) identifying and controlling key variables in the process methodology, such as weight ratio, acid and base species and temperature, and (ii) seeding-based technology is of particular significance, providing repeatable and controllable processing of desired boehmite particulate material morphologies.

Figure 1:
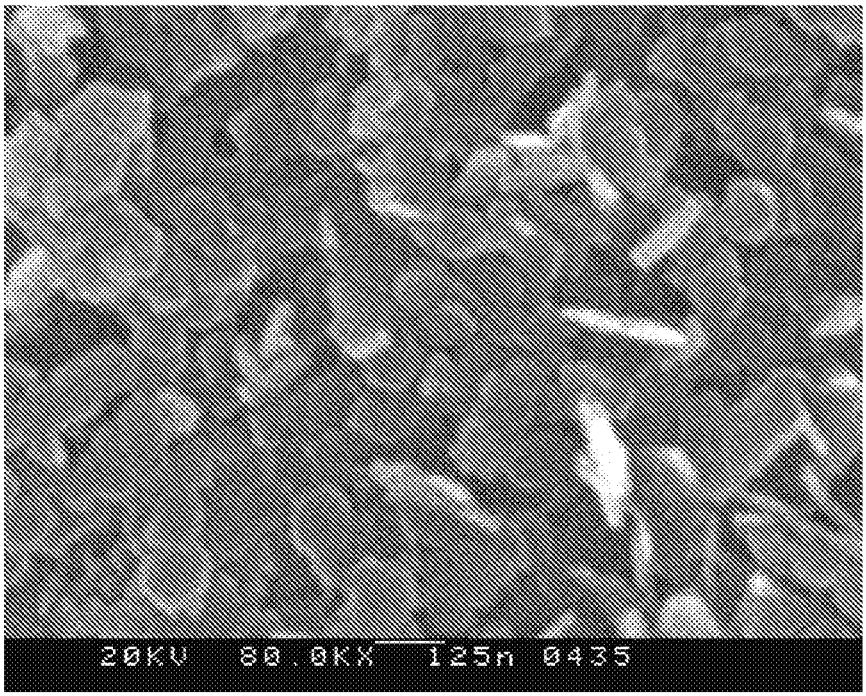
FIG. 1 is an illustrative image of exemplary platelet shaped particles.
Figure 2:
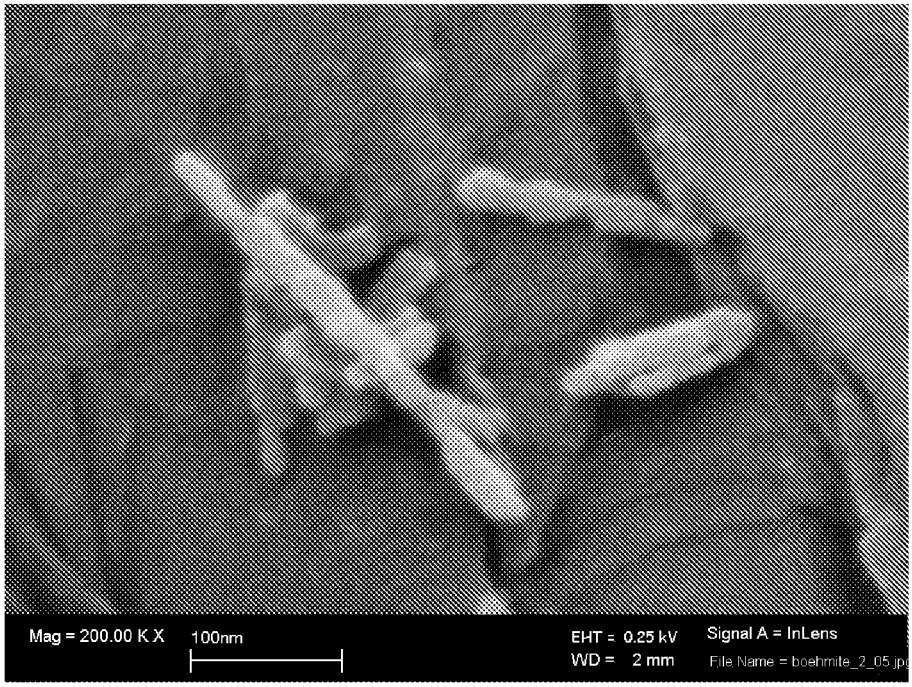
FIG. 2 is an illustrative image of exemplary needle shaped particles.
Figure 3:
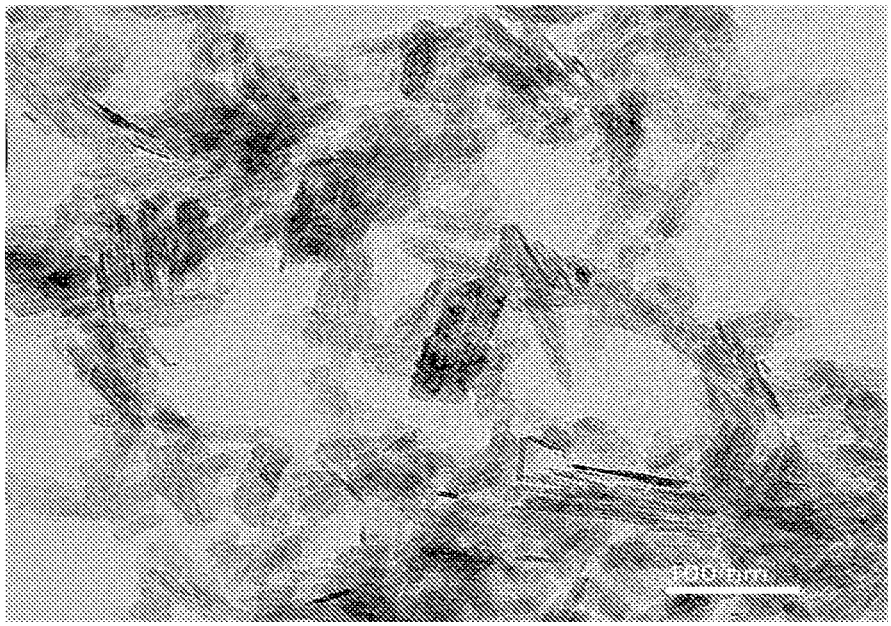
FIG. 3 is an illustrative image of exemplary needle shaped particles having nodular structure.

Additional characterization studies were carried out to more precisely understand the effect of seeding on particle morphology. FIG. 1 illustrates the platelet shapes particles as discussed above. FIG. 2 illustrates needle shaped particles as discussed above. FIG. 2 reveals that the seeded particles have a nodular structure, in that the particles are 'bumpy' or 'knotty' and have a generally rough outer texture. Further characterization was carried out by TEM analysis to discover that what appears by SEM to be generally monolithic particles, the particles are actually formed of tight, dense assemblies of platelet particles as shown in FIG. 3. The particles have a controlled aggregate morphology, in that the aggregates display a level of uniformity beyond conventional aggregate technologies. It is understood that the controlled aggregate structures form the nodular structure, and are unique to the seeded approach discussed above.

Figure 4:
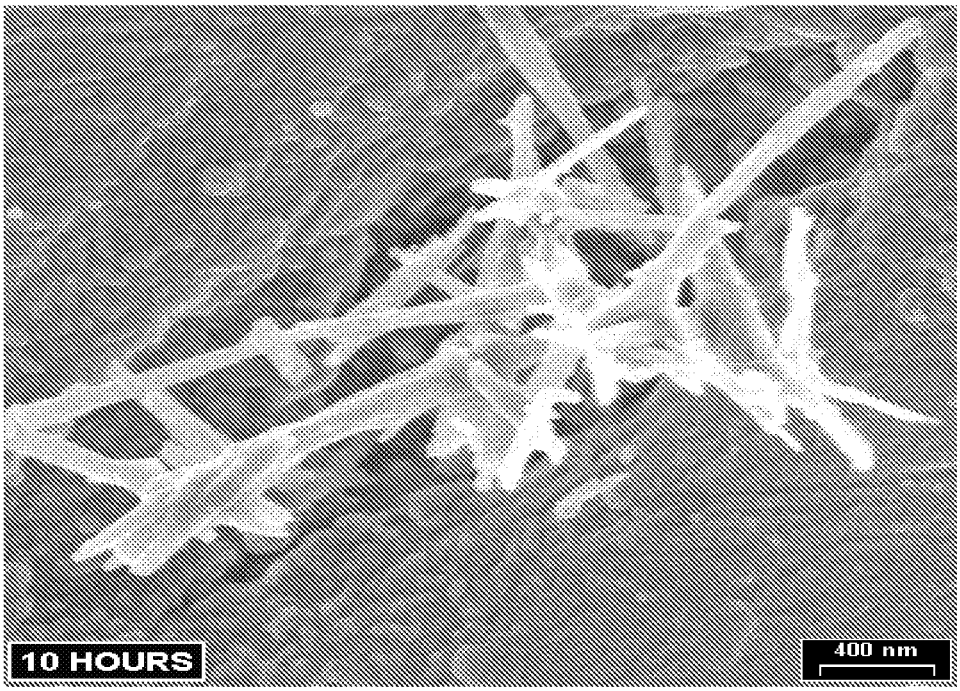
FIG. 4 is an illustrative image of prior art smooth hair-like particles.

It is recognized that non-seeded approaches have been found to form particulate material, including approaches that decompose raw materials through consumption of an aluminum salt, such as aluminum nitrate or aluminum sulfate. However, these metal salt decomposition approaches form morphologically distinct particulates that are devoid of the seeded morphology, notably lacking the nodular structure. FIG. 4 is representative of such materials, showing non-seeded morphology that has a smooth or hair-like outer surface texture. Examples of such non-seeded approaches include those disclosed in U.S. Pat. No. 3,108,888 and U.S. Pat. No. 2,915,475, and thesis paper Preparation and Characterization of Acicular Particles and Thin Films of Aluminum Oxide, by Raymond M. Brusasco, May 1987. The material shown in FIG. 4 was formed the process disclosed in JP2003-054941.

In particular, Applicants have discovered particular technical advantages associated with paper products including aluminous material in one or more layers. Such features include improved flexural modulus, enhanced resolution, and improved image durability. Further improvements are believed to result from use of aggregated forms of the aluminous material in various layers of the paper products.

While the invention has been illustrated and described in the context of specific embodiments, it is not intended to be limited to the details shown, since various modifications and substitutions can be made without departing in any way from the scope of the present invention. For example, additional or equivalent substitutes can be provided and additional or equivalent production steps can be employed. As such, further modifications and equivalents of the invention herein disclosed may occur to persons skilled in the art using no more than routine experimentation, and all such modifications and equivalents are believed to be within the scope of the invention as defined by the following claims.

What is claimed is:

1. An inkjet paper comprising:

a substrate;

an image recording layer overlying at least one side of the substrate;

a humidity barrier layer overlying the image recording layer, and an absorbent layer overlying the humidity barrier layer, wherein the image recording layer includes a polymer and an aluminous material at least partially dispersed within the polymer, the polymer selected from the group consisting of polyvinyl alcohol, polyurethane, butadiene-styrene copolymer, cellulose acetate proprionate, and any combination thereof, and the aluminous material having a primary aspect ratio of at least about 1.5, a secondary aspect ratio of not greater than about 3.0, and a primary particle size between about 50 nm and about 1000 nm, and wherein the absorbent layer includes at least one different polymer than in the image recording layer.

2. The inkjet paper of claim 1, wherein the humidity barrier layer includes at least one different polymer than in the image recording layer.

3. The inkjet paper of claim 1, wherein the aluminous material is a transition alumina.

4. The inkjet paper of claim 1, wherein the absorbent layer includes a polymer selected from the group consisting of a thermoplastic polyolefin, poly(halo-substituted olefin), polyester, polyamide, polyurea, poly(vinyl halide), poly(vinylidene halide), polystyrene, poly(vinyl ester), polycarbonate, polyether, polysulfide, polyimide, polysilane, polysiloxane, polycaprolactone, polyacrylate, polyethylene, polymethacrylate, and any combination thereof.

5. The inkjet paper of claim 1, wherein the humidity barrier layer includes polyethylene oxide.

6. A paper comprising:

a paper substrate;

an image recording layer overlying the paper substrate;

a humidity barrier layer overlying the image recording layer; and an absorbent layer overlying the humidity barrier layer, wherein at least one of the paper substrate, the image recording layer, or the humidity barrier layer, includes an aluminous material having a primary aspect ratio of at least about 1.5, a secondary aspect ratio of not greater than about 3.0, and a primary particle size between about 50 nm and about 1000 nm, and wherein the absorbent layer includes at least one different polymer than in the image recording layer.

7. The paper of claim 6, wherein the paper substrate includes the aluminous material.

8. The paper of claim 6, wherein the image recording layer, the humidity barrier layer, and the absorbent layer contain the aluminous material.

9. The paper of claim 6, wherein at least two of the image recording layer, the humidity barrier layer, and the absorbent layer includes the aluminous material.

10. The paper of claim 6, wherein the humidity barrier layer includes polyethylene oxide.

11. The paper of claim 6, wherein the image recording layer includes a polymer selected from the group consisting of polyvinyl alcohol, polyurethane, butadiene-styrene copolymer, cellulose acetate proprionate, and any combinations thereof.

12. The paper of claim 6, wherein the absorbent layer includes a polymer selected from the group consisting of a thermoplastic polyolefin, poly(halo-substituted olefin), polyester, polyamide, polyurea, poly(vinyl halide), poly(vinylidene halide), polystyrene, poly(vinyl ester), polycarbonate, polyether, polysulfide, polyimide, polysilane, polysiloxane, polycaprolactone, polyacrylate, polyethylene, polymethacrylate, and any combinations thereof.

* * * * *